US006557992B1

(12) United States Patent
Dwyer et al.

(10) Patent No.: US 6,557,992 B1
(45) Date of Patent: May 6, 2003

(54) METHOD AND APPARATUS FOR DECORATING AN IMAGING DEVICE

(75) Inventors: Daniel R. Dwyer, Battle Ground, WA (US); Peter G. Hwang, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/014,942

(22) Filed: Oct. 26, 2001

(51) Int. Cl.[7] ..... B41J 29/13
(52) U.S. Cl. ..... 347/108
(58) Field of Search ..... 347/2, 3, 108, 347/109; D18/4, 50; 40/515, 591, 765

(56) References Cited

U.S. PATENT DOCUMENTS 5,592,361 A 1/1997 Smith et al. ..... 361/679
D386,515 S * 11/1997 Sommerville et al. ..... D18/4
D387,378 S * 12/1997 Sugimoto ..... D18/50
5,796,575 A 8/1998 Podwalny et al. ..... 361/681
D413,142 S * 8/1999 Pangburn ..... D18/55
5,974,401 A * 10/1999 Enomoto et al. ..... 705/40
6,067,738 A * 5/2000 Zeligson ..... 40/611

OTHER PUBLICATIONS

Sony New Releases, http://www.sony–asia.com.sg/news/sep00cnews4.html, "Sony Offers New Ways of Enjoying Digital Still Cameras With the New 'Cyber–shot'", Sep. 12, 2000.

Sony Website, http://www.sony.co.jp/sd/products/Consumer/popegg/printer.html, "PrintFan with Popegg".

* cited by examiner

*Primary Examiner*—John Barlow
*Assistant Examiner*—An H. Do
(74) *Attorney, Agent, or Firm*—Charles F. Moore

(57) ABSTRACT

An imaging device includes a housing, a first door rotatably coupled to the housing and a second transparent door overlying the first door. A decorative sheet between the first door and the second transparent door allows the imaging device to be customized in appearance.

12 Claims, 3 Drawing Sheets

METHOD AND APPARATUS FOR DECORATING AN IMAGING DEVICE

INTRODUCTION

The present invention relates generally to imaging devices, such as inkjet and electrophotographic printers.

Imaging devices such as personal printers for the home user have become pervasive in recent years. The majority of these devices are fairly uniform in appearance and are either a dull beige or gray in color. Particularly to those users who appreciate creativity and value individuality, these devices are aesthetically unpleasing and even boring.

Some imaging device manufacturers have attempted to inject life into the appearance of their devices by producing unique versions of a particular device. For example, in 1999 Tektronix, Inc. produced a "Designer Edition" of its standard Phaser® 840 color inkjet printer. The standard 840 printer utilized an ordinary beige molded plastic housing. The "Designer Edition", however, featured an eye-catching icy blue transparent housing and was designed to match a Power Macintosh® G3 computer which had a similar transparent blue housing.

A drawback with producing unique or "designer" versions of imaging devices is that each version requires separate case parts, non-standard materials, unique painting and/or other expensive modifications. Additionally, each specially designed version of an imaging device will likely appeal to only a subset of the potential market for the device.

It would be desirable to provide an imaging device that is easily customized or decorated by a user, and a method for easily and inexpensively decorating an imaging device to create a customized appearance.

DETAILED DESCRIPTION OF THE PREFERRED EMBODIMENTS

Figure 1:
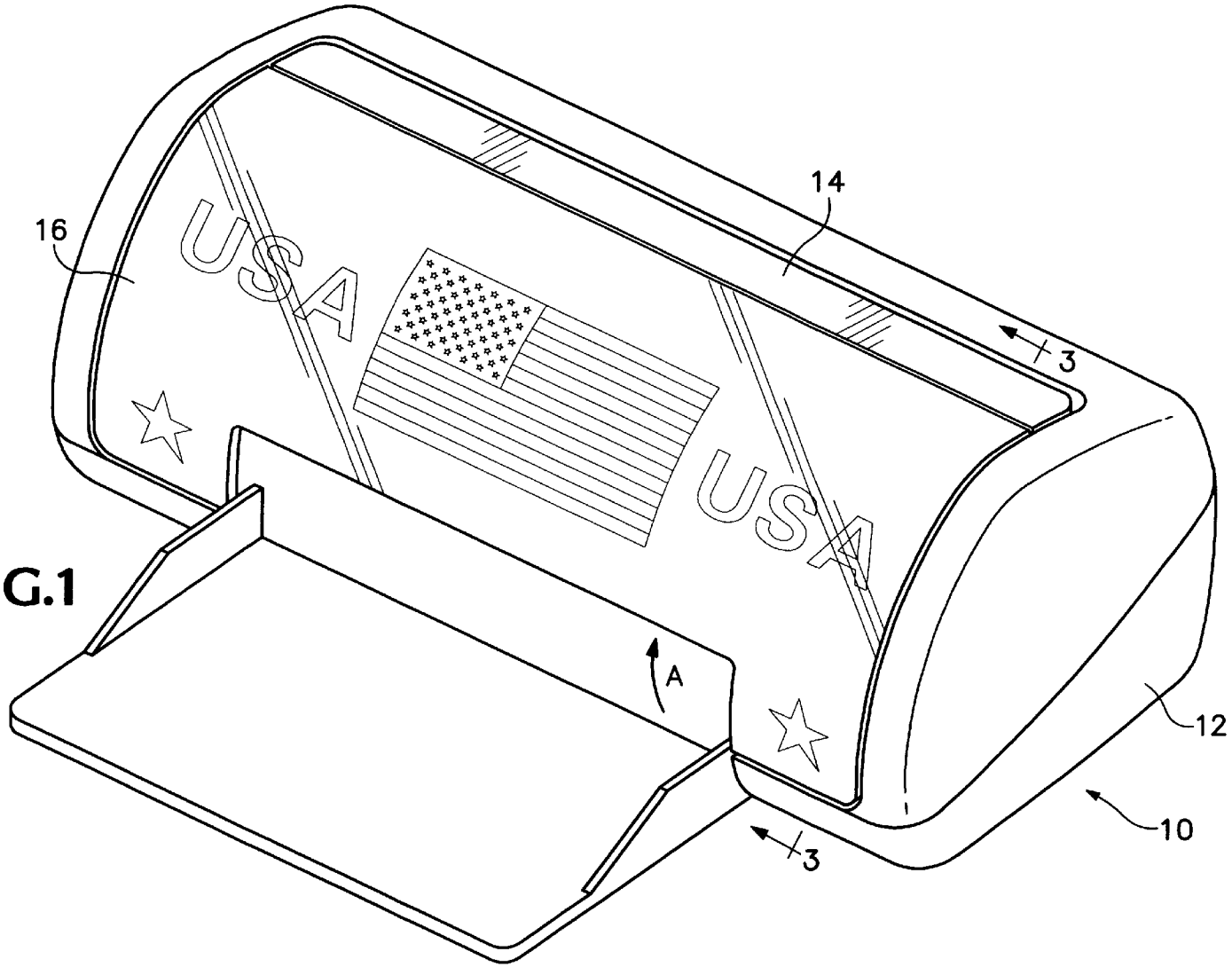
FIG. 1 is an overall perspective view of one embodiment of an imaging device of the present invention.

FIG. 1 illustrates an embodiment of an imaging device 10, such as an inkjet printer, which may be constructed according to the present invention. It will be appreciated that the present invention may be embodied in and/or practiced with various other types of imaging devices, including but not limited to electrophotographic printers, fax machines, multifunction imaging devices, copiers, video printers, scanning devices and the like.

The imaging device 10 includes a housing 12 typically made of a plastic material that substantially encloses the operative components of the imaging device. In an inkjet printer, these components may include an inkjet printhead mounted on a reciprocating carriage, a media handling system and a controller and other electronics for controlling the operation of the printhead, carriage and media handling system (not shown). The general operation of an inkjet printer and these components will be well known to those of ordinary skill in the art, and is not necessary to an understanding of the concepts of the present invention.

Figure 2:
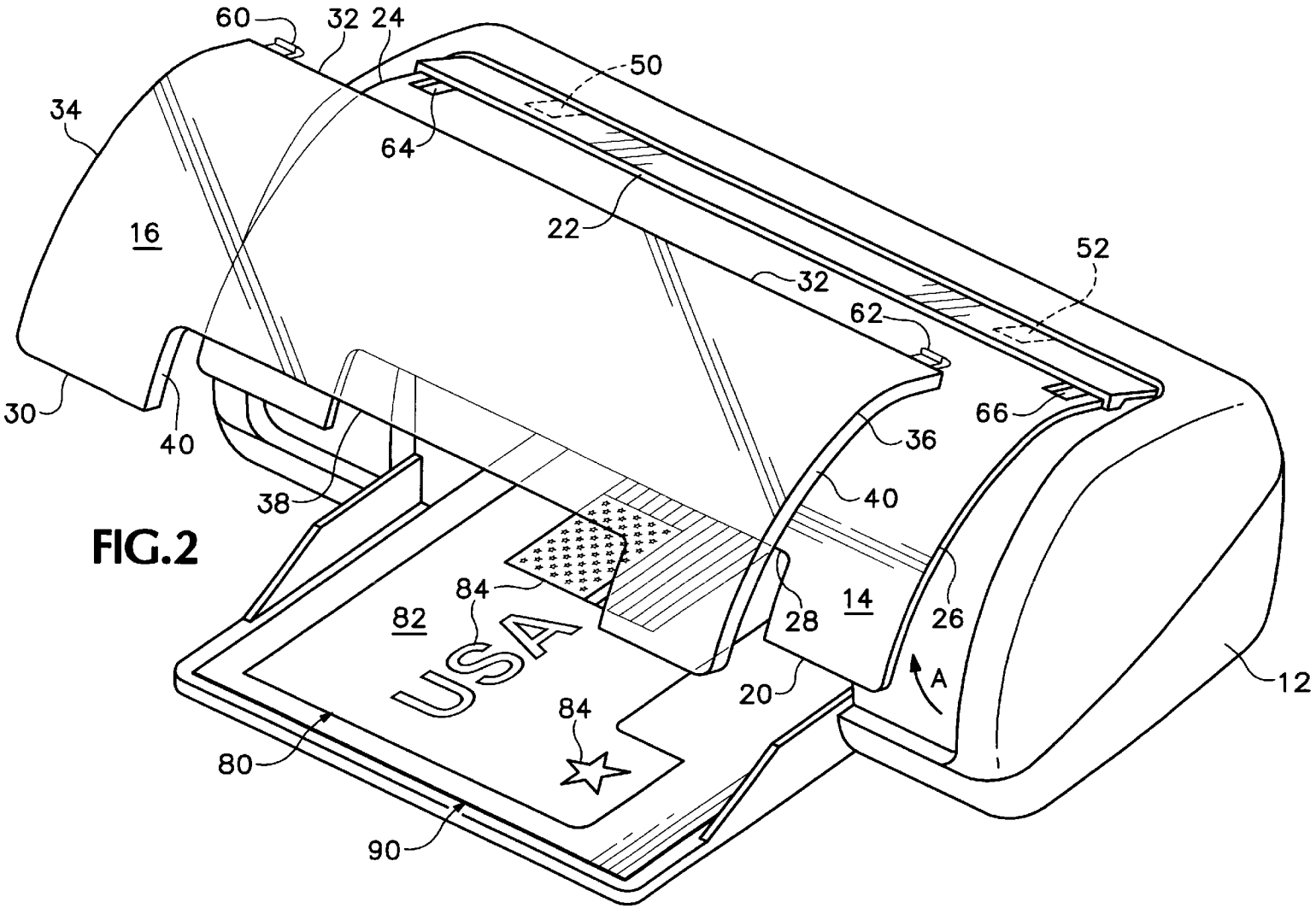
FIG. 2 shows an exploded view of the imaging device of FIG. 1 with the decorative sheet being printed by the imaging device.

As shown in FIGS. 1 and 2, the imaging device includes a first door 14 rotatably coupled to the housing 12 and a second transparent door 16 that overlies the first door. The first door 14 includes a front edge 20, a rear edge 22 opposite the front edge, a left edge 24 and a right edge 26 opposite the left edge. The front edge 20 includes a cutaway portion 28 that defines an opening for media travel into and out of the housing 12.

The second transparent door 16 includes a front edge 30, a rear edge 32 opposite the front edge, a left edge 34 and a right edge 36 opposite the left edge. The front edge 30 includes a cutaway portion 38 that defines an opening for media travel into and out of the housing 12. It will be appreciated that the first door 14 and the second door 16 have a similar shape. More specifically, the second door 16 has a curvature and the first door 14 has a curvature that substantially matches the curvature of the second door.

Figure 3:
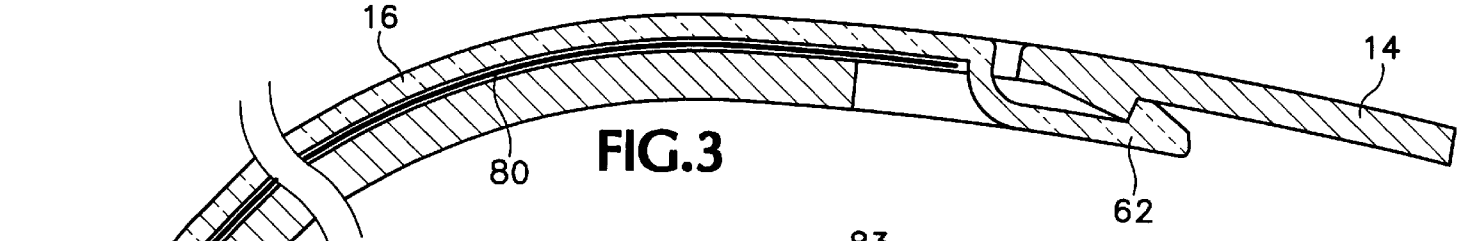
FIG. 3 is a sectional view taken along line 3—3 of FIG. 1 showing the first door, the decorative sheet and the second door.

With reference now to FIGS. 2 and 3, the second door 16 includes a lip 40 that protrudes inwardly in the direction of the curvature of the second door. In the embodiment shown, the lip 40 extends substantially along the front edge 30, the left edge 34 and the right edge 36 of the second door 16. As explained in more detail below, the lip 40 releasably secures the first door 14 adjacent to the second door 16.

FIG. 1 shows the first door 14 and second door 16 in a closed position on the housing 12. Should a user require access to components inside the housing 12, the first door 14 and second door 16 may be rotated upwardly in the direction of action arrow A. FIG. 2 shows the first door 14 partially rotated upwardly. In this embodiment, the first door 14 is rotatably coupled to the housing 12 by a first hinge 50 and a second hinge 52.

As explained in more detail below, a decorative sheet 80 is positioned between the first door 14 and the second door 16 to customize the appearance of the imaging device 10. In the embodiment illustrated, the second door 16 is releasably secured to the first door 14 to allow a user to easily change the decorative sheet 18. As shown in FIGS. 2 and 3, the second door 16 includes a first tab 60 and a second tab 62 that releasably press fit into a corresponding first slot 64 and second slot 66, respectively, in the first door 14. Advantageously, a user may change or customize the appearance of the imaging device 10 by simply decoupling the second door 16 from the first door 14, removing the decorative sheet 80 and inserting a different decorative sheet.

Figure 4:
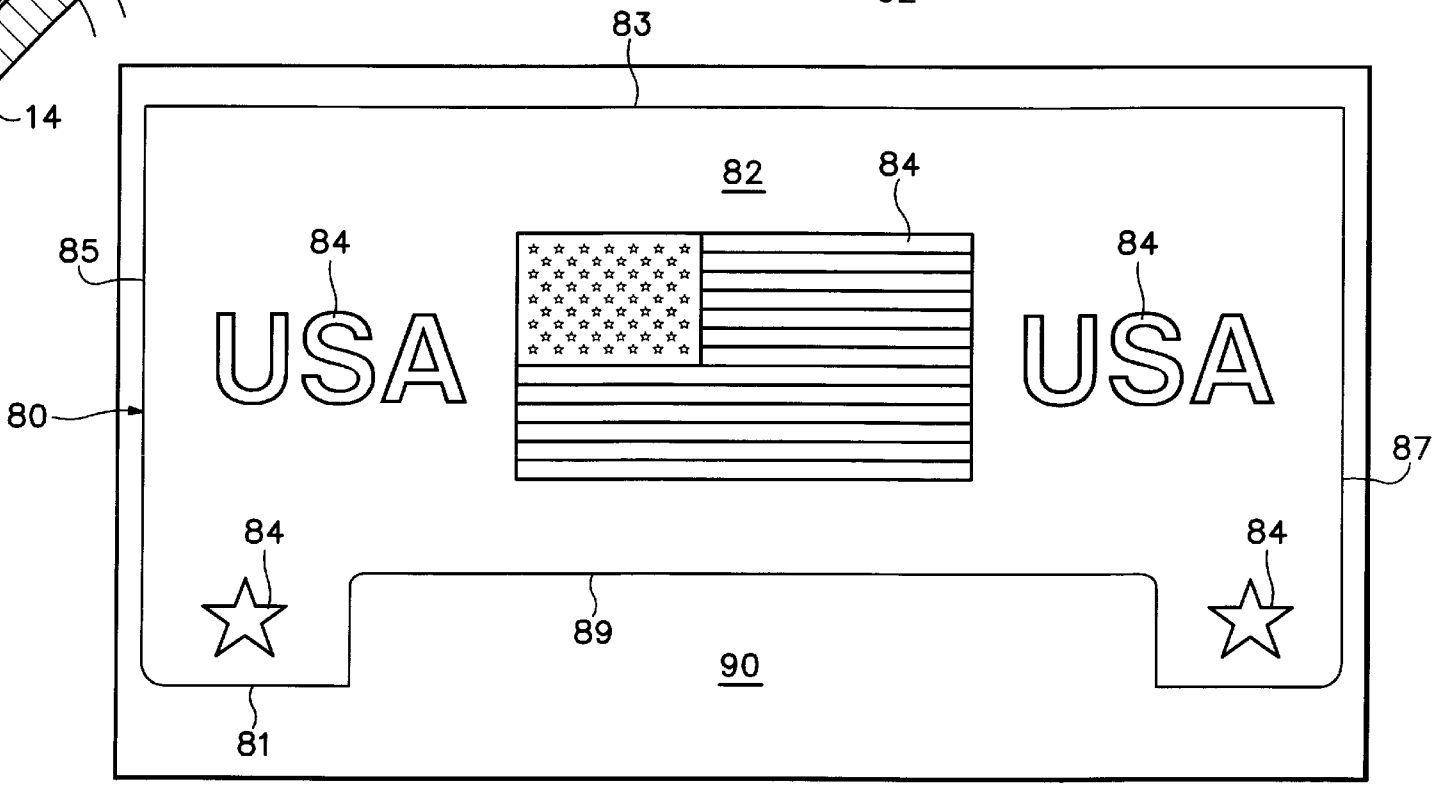
FIG. 4 is a plan view of one embodiment of the decorative sheet embodied on a media sheet.

With reference now to FIG. 4, the decorative sheet 80 includes a top surface 82 that contains decoration 84. It will be appreciated that a variety of decorations may be used on the decorative sheet 80, such as artwork, images, photographs, drawings, etc. As shown in FIG. 1, when installed in the imaging device 10 the top surface 82 of the sheet 80 is adjacent to the second door 16 such that the decoration is visible through the second door 16. More specifically, a user may decorate the imaging device by placing the decorative sheet 80 behind the transparent second door 16 and orienting the top surface 82 to be adjacent to the second door.

It will be appreciated that the shape of the decorative sheet 80 substantially corresponds to the shape of the transparent second door 16 when the decorative sheet is installed behind the door as shown in FIGS. 1 and 3. More specifically, the decorative sheet 80 includes a front border 81, a rear border 83 opposite the front border, a left border 85 and a right border 87 opposite the left border. A distance between the front border 81 and the rear border 83 is substantially equal to the distance along the curvature of the second door 16 between the front edge 30 of the second door and the rear edge 32 of the second door. Additionally, the distance between the left border 85 of the decorative sheet 80 and the right border 87 of the decorative sheet is substantially equal to the distance between the left edge 34 of the second door 16 and the right edge 36 of the second door. As described above, the second door 16 also includes a cutaway portion 38 that defines an opening for media travel into and out of the housing 12. With reference to FIG. 4, the decorative sheet 80 includes a cutaway portion 89 along the front border 81 that substantially matches the cutaway portion 38 in the second door 16.

As described above, the second door 16 includes a lip 40 that protrudes inwardly in the direction of the curvature of the second door. In one embodiment, the lip 40 extends substantially along the front edge 30, left edge 34 and right edge 36 of the second door 16. With reference to FIG. 3, the lip 40 serves to releasably seat the decorative sheet 80 adjacent to the second door 16.

The decoration 84 may be printed on the top surface 82 of the decorative sheet 80 by the imaging device 10. In another aspect of the present invention, multiple different decorations may be provided on a memory device, such as a CD-ROM, and selected by the user for printing on the decorative sheet 80. A user may also download decorations from a remote content source, such as a content provider on the Internet. A user may also design a custom decoration and print that decoration on the decorative sheet 80 with the imaging device 10. Alternatively, a user may utilize pre-printed decorative sheets that are separately purchased or provided with the imaging device 10.

The decorative sheet 80 illustrated in FIG. 4 is shown as part of a larger media sheet 90. In another aspect of the present invention, a user may print the decoration 84 within a predetermined area of the media sheet 90, the predetermined area forming an outline of the decorative sheet 80. In one embodiment, printing the decoration 84 includes printing an outline or cutting guide on the media sheet that outlines the decorative sheet 80. Alternatively, the cutting guide may be pre-printed on the media sheet 90. A user may then cut along the cutting guide to separate the decorative sheet 80 from the media sheet.

In another embodiment, the media sheet 90 may include perforations that outline the decorative sheet 80. A user may print the decoration 84 within a predetermined area that is formed by the perforations and outlines the shape of the decorative sheet 80. The user may then separate the decorative sheet 80 from the media sheet 90.

It is apparent that a variety of other, equivalent modifications and substitutions may be made to the apparatus and method of the present invention according to the concepts covered herein, depending upon the particular implementation, while still falling within the scope of the claims below.

We claim:

1. An imaging device comprising:

a housing;

a first door rotatably coupled to the housing:

a second transparent door overlying the first door, the first door being between the second door and the housing, the second door having a curvature and including a lip protruding inwardly in a direction of the curvature; and a decorative sheet between the first door and the second transparent door.

2. The imaging device of claim 1, wherein the second door includes a front edge, a rear edge opposite the front edge, a left edge and a right edge opposite the left edge, and wherein the lip extends substantially along the front edge, the left edge and the right edge.

3. The imaging device of claim 1, wherein the first door has a curvature substantially matching the curvature of the second door.

4. The imaging device of claim 1, wherein the lip of the second door releasably secures the first door adjacent to the second door.

5. The imaging device of claim 2, wherein the second door includes a cutaway portion along the front edge defining an opening for media travel.

6. An imaging device comprising:

a housing;

a first door rotatably coupled to the housing, the first door including a front edge, a rear edge opposite the front edge, a left edge and a right edge opposite the left edge, the front edge including a cutaway portion defining an opening for media travel;

a second transparent door overlying the first door, the first door being between the second door and the housing; and a decorative sheet between the first door and the second transparent door.

7. An imaging device comprising:

a housing;

a first door rotatably coupled to the housing;

a second transparent door overlying the first door, the first door being between the second door and the housing, the second door having a curvature and including a front edge, a rear edge opposite the front edge, a left edge and a right edge opposite the left edge; and a decorative sheet between the first door and the second transparent door, the decorative sheet including a top surface containing decoration printed on the decorative sheet by the imaging device, the top surface being adjacent to the second door, the decorative sheet including a front border, a rear border opposite the front border, a left border and a right border opposite the left border, and wherein a distance between the front border and the rear border is substantially equal to a distance along the curvature of the second door between the front edge of the second door and the rear edge of the second door.

8. The imaging device of claim 7, wherein a distance between the left border of the decorative sheet and the right border of the decorative sheet is substantially equal to a distance between the left edge of the second door and the right edge of the second door.

9. The imaging device of claim 8, wherein the second door includes a lip protruding inwardly in the direction of the curvature, the lip extending substantially along the front edge, the left edge and the right edge of the second door, and wherein the decorative sheet is releasably seated adjacent to the second door by the lip.

10. The imaging device of claim 9, wherein the second door includes a cutaway portion along the front edge of the second door defining an opening for media travel, and the front border of the decorative sheet includes a cutaway portion substantially matching the cutaway portion in the second door.

11. A method of decorating an imaging device having a transparent door, comprising:

using the imaging device to print decoration within a predetermined area on a media sheet, the predetermined area outlining a top surface of a decorative sheet;

providing perforations on the media sheet that outline the decorative sheet;

separating the decorative sheet from the media sheet;

placing the decorative sheet behind the transparent door on the imaging device; and orienting the top surface of the decorative sheet to be adjacent to the transparent door, whereby the decoration may be viewed through the transparent door.

12. A method of decorating an imaging device having a transparent door, comprising:

using the imaging device to print decoration within a predetermined area on a media sheet, the predetermined area outlining a top surface of a decorative sheet;

providing a cutting guide on the media sheet that outlines the decorative sheet, cutting along the cutting guide to separate the decorative sheet from the media sheet;

placing the decorative sheet behind the transparent door on the imaging device; and orienting the top surface of the decorative sheet to be adjacent to the transparent door, whereby the decoration may be viewed through the transparent door.

* * * * *